United States Patent [19]

Carlisle

[11] 4,028,044

[45] June 7, 1977

[54] FUEL BURNERS

[75] Inventor: Denis Richard Carlisle, Risley, England

[73] Assignee: Rolls-Royce (1971) Limited, London, England

[22] Filed: Sept. 30, 1975

[21] Appl. No.: 618,238

[30] Foreign Application Priority Data

Oct. 7, 1974 United Kingdom ..... 43418/74

[52] U.S. Cl. ..... 431/158; 60/39.74 R; 431/353

[51] Int. Cl.[2] ..... F23R 1/00

[58] Field of Search ..... 431/354, 353, 217, 158, 431/265, 177, 178, 182, 183; 239/533, 568, 559, 405, 406, 425, 426, 428, 431, 434, 567, 419, 419.3, 427.3; 60/39.74 R

[56] References Cited

UNITED STATES PATENTS

| | | | |
|---|---|---|---|
| 2,344,400 | 3/1944 | Ehnbom | 239/567 |
| 3,469,790 | 8/1969 | Duncan | 431/265 |
| 3,525,508 | 8/1970 | Berry et al. | 239/568 |
| 3,593,518 | 7/1971 | Gerrard | 431/352 |
| 3,947,215 | 3/1976 | Peterson et al. | 23/277 C |
| 3,961,475 | 6/1976 | Wood | 431/177 |

FOREIGN PATENTS OR APPLICATIONS

| | | | |
|---|---|---|---|
| 1,401,762 | 10/1968 | Germany | 431/177 |

*Primary Examiner*—Edward G. Favors
*Assistant Examiner*—Robert J. Charvat
*Attorney, Agent, or Firm*—Cushman, Darby & Cushman

[57] ABSTRACT

A gas turbine engine fuel burner comprises the combination of an atomising fuel nozzle and a vaporizing duct in which the atomised fuel is arranged to impinge on the wall of the vaporizing duct and mix with a portion of the compressor delivery air from the engine compressor. The resultant fuel and air mixture flows into the combustion chamber through a plurality of equispaced elongated slots formed in the cylindrical wall of the vaporizing duct, each of the elongated slots having its major axis or longest side extending parallel to the longitudinal axis of the duct.

4 Claims, 2 Drawing Figures

FUEL BURNERS

This invention relates to fuel burners for use in gas turbine engine power plants.

According to the present invention there is provided a gas turbine engine fuel burner comprising a fuel supply means having at least one fuel nozzle and a vapourising and premixing duct which is arranged to receive both fuel from the fuel supply means and a supply of compressed air, the vapourising and premixing duct having at least one outlet comprising a plurality of slots spaced around the periphery of the duct.

The fuel supply means may comprise a burner arm and a single nozzle arranged to receive liquid fuel or the burner may have a pilot nozzle and a main nozzle. In a further arrangement, the burner may be a dual fuel burner and have a third nozzle which is arranged to receive a supply of gaseous fuel. The vapourising and premixing duct may be circular in section and the slots may be elongated and have their major axis or longest side extend parallel to the longitudinal axis of the duct.

Figure 1:
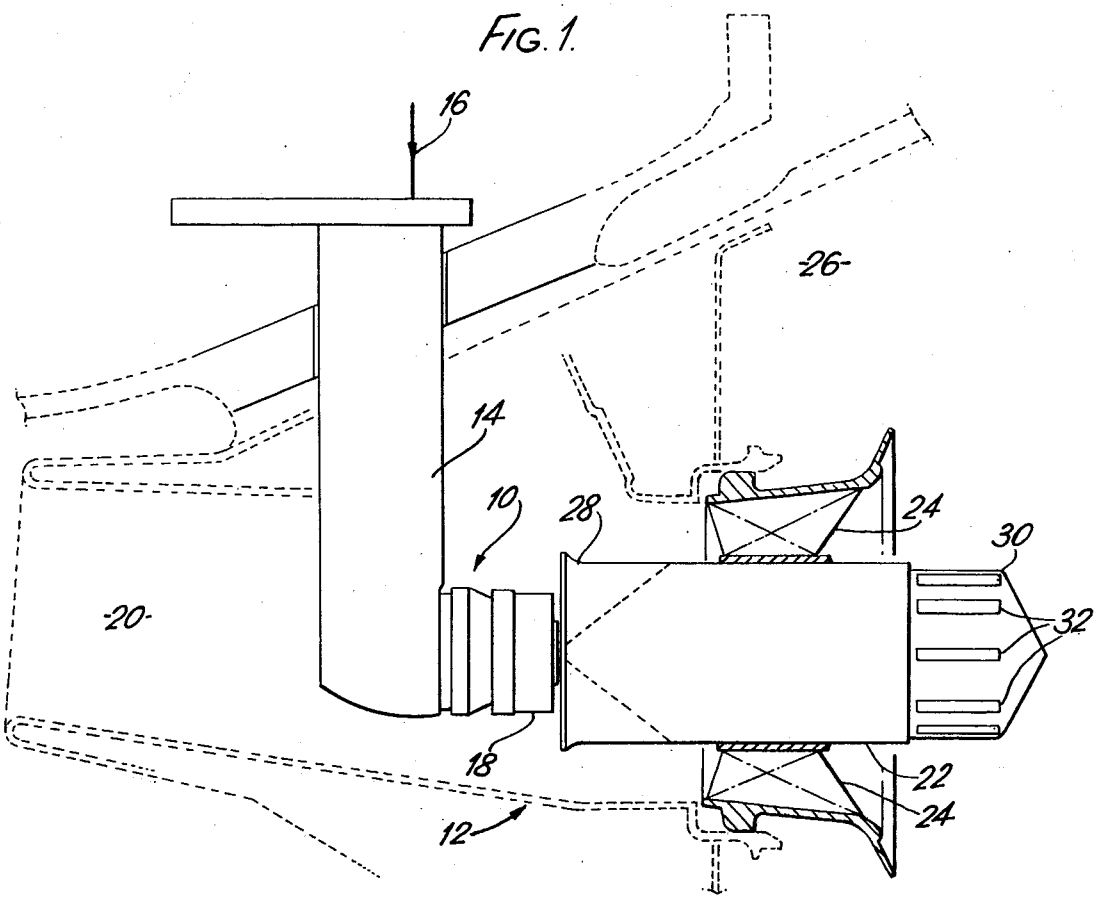
Figure 2:
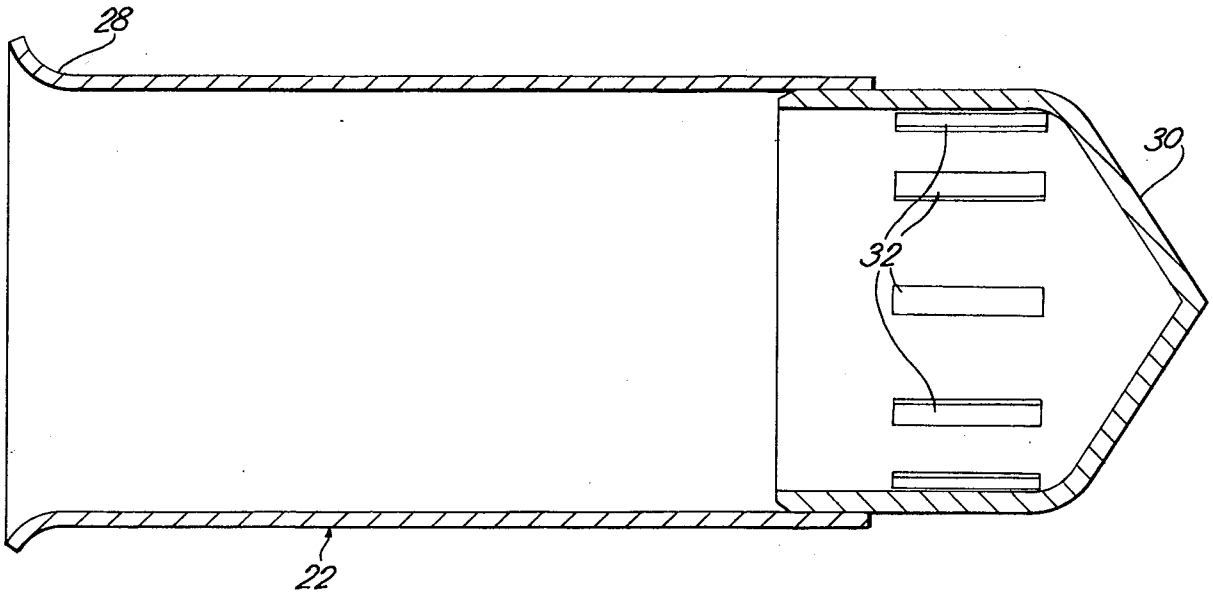

The present invention will now be more particularly described with reference to the accompanying drawings in which:

FIG. 1 shows an elevation of one form of fuel burner according to the present invention, and FIG. 2 shows a sectional elevation of the vapourising and premixing duct of the fuel burner shown in FIG. 1 to a larger scale.

Referring to the drawings, a fuel burner 10 is located within the combustion equipment 12 of a gas turbine engine (only parts of which are shown). The burner comprises arm 14 which is arranged to receive a supply of liquid fuel 16 and a fuel nozzle 18 having a spray angle within the range 50° to 110°, which is attached to the burner arm, the arm and the nozzle assembly being located within a compressed air inlet duct 20 for the combustion equipment.

A vaporizing and premixing duct 22 is located downstream of the fuel nozzle 18 and is held in position within a ring of air swirler vanes 24 which are located at the entrance to the combustion chamber 26 of the combustion equipment.

The duct 22 is circular in section and the upstream end has a slightly enlarged inlet 28 to receive compressed air from the compressor of the gas turbine engine, the mass flow of compressed air into the duct being such that the air to fuel ratio in the duct is in the range 1 to 7 through the speed range of the engine, although the air to fuel ratio can be arranged to vary from these limits by suitable choice of size of the duct 22. The downstream end of the duct is closed off by an end cap 30 and has an outlet in the form of a plurality of equi-spaced elongate slots 32 around the periphery of the cap. It has been found advantageous for the ratio of the area occupied by the slots 32 to be one third of the exterior surface ara of the duct between the slots and the extremities of the slots. This spacing provides a reasonably large area between adjacent slots which is required to ensure good weak extinction characteristics.

In operation, atomised fuel is sprayed from the nozzle 18 at a relatively wide angle so that it impinges on the hot wall of the duct 22 where it vapourises both as a result of this contact and contact with the compressed air which is flowing through the duct 22. The vapourised fuel and air mixture then passes out through the slots 32 into the combustion chamber 26 where it is burnt.

It has been found that a fuel burner constructed as described above gives good combustion efficiency because of efficient vapourisation within the vapourising and premixing duct; low smoke emissions because the wide spray angle prevents fuel from passing along the centre of the duct and good weak extinction because the relatively large 'dead' areas between adjacent slots in the duct ensures combustion at high air to fuel ratio.

Whilst the fuel burner has been described only having a single liquid fuel nozzle, the burner may have a pilot fuel nozzle and a main fuel nozzle and for industrial purposes, the fuel burner will have a pilot nozzle of relatively narrow angle to provide atomised fuel for starting, because heavy fuels may be used. Also, the burner may be a dual fuel burner and be provided with a supply of gaseous fuel and a gas fuel nozzle. Also, the duct may terminate in one or more arms at right angles to the axis of the duct with the slots being provided at the ends of the or each arms.

I claim:

1. A gas turbine engine fuel burner positioned in a combustion chamber comprising:

a fuel supply means having at least one fuel nozzle and a vaporizing and pre-mixing duct which is arranged to receive both fuel from the fuel supply means and a supply of compressed air, said vaporizing and pre-mixing duct being closed off at its downstream end and having an outlet just upstream of the downstream end for discharging a vaporized mixture of fuel and compressed air into the combustion chamber for burning therein, said outlet comprising a plurality of slots spaced around the periphery of the duct, said slots being elongated and having the longest side of each slot extending substantially parallel to the longitudinal axis of the duct, said slots having a total surface area which is substantially one third of a total exterior area of said vaporizing and pre-mixing duct between extremities of the slots whereby the fuel burner has good weak extinction characteristics.

2. A fuel burner as claimed in claim 1 which the slots are rectangular.

3. A gas turbine engine fuel burner positioned in a combustion chamber comprising a fuel supply means including at least one fuel nozzle and a vaporizing and pre-mixing duct which is arranged to receive both fuel from the fuel supply means and a supply of compressed air, said duct being substantially cylindrical and having its downsteam end closed off and an outlet immediately upstream of the downstream end for discharging a vaporized mixture of fuel and compressed air into the combustion chamber for burning therein, said outlet comprising a plurality of slots spaced around the periphery of the duct, said slots being elongated and having the major axis of each slot extending substantially parallel to the longitudinal axis of the duct, said slots having a total surface area which is substantially one third of a total exterior area of said vaporizing and pre-mixing duct between extremities of the slots whereby the fuel burner has good weak extinction characteristics, said duct having its upstream end open and positioned substantially adjacent to a radial plane through the end of said fuel nozzle, and said fuel nozzle having a wide spray angle for the discharge of fuel such that the fuel is impinged onto the inner wall of said duct.

4. A gas turbine engine fuel burner as claimed in claim 3 in which the spray angle of said fuel nozzle is within the range of 50° to 110°.

* * * * *